United States Patent [19]

Holden

[11] Patent Number: 4,610,412

[45] Date of Patent: Sep. 9, 1986

[54] FASCIA-GUTTER BRACKET ASSEMBLY

[75] Inventor: John M. Holden, Brisbane, Australia

[73] Assignee: Speedifix Building Components Pty. Ltd., Queensland, Australia

[21] Appl. No.: 642,681

[22] PCT Filed: Dec. 20, 1983

[86] PCT No.: PCT/AU83/00189

§ 371 Date: Aug. 20, 1984

§ 102(e) Date: Aug. 20, 1984

[87] PCT Pub. No.: WO84/02552

PCT Pub. Date: Jul. 5, 1984

[30] Foreign Application Priority Data

Dec. 20, 1982 [AU] Australia ..... PF7334

[51] Int. Cl.[4] ..... E04D 13/06

[52] U.S. Cl. ..... 248/48.2; 248/297.3

[58] Field of Search ..... 248/48.1, 48.2, 297.3, 248/225.1; 52/11, 60, 95, 96

[56] References Cited

U.S. PATENT DOCUMENTS

| | | | |
|---|---|---|---|
| 1,594,101 | 7/1926 | Knab | 248/48.2 |
| 2,448,750 | 9/1948 | Van Wert . | |
| 2,783,014 | 2/1957 | Kenney | 248/542 X |
| 3,344,562 | 10/1967 | Miles et al. | 248/48.2 X |
| 3,550,381 | 12/1970 | South | 248/48.1 X |
| 3,864,882 | 2/1975 | Lasscock | 248/48.1 X |
| 3,874,131 | 4/1975 | Webster | 248/48.2 X |
| 4,128,974 | 12/1978 | Taylor | 52/11 |
| 4,195,452 | 4/1980 | Smith | 248/48.1 X |
| 4,227,352 | 10/1980 | Hallam | 52/11 |
| 4,254,930 | 3/1981 | Warren | 248/542 |
| 4,407,478 | 10/1983 | Hodges | 248/542 |

FOREIGN PATENT DOCUMENTS

| | | | |
|---|---|---|---|
| 60542/73 | 3/1975 | Australia . | |
| 60761/73 | 3/1975 | Australia . | |
| 472139 | 3/1975 | Australia | 248/48.2 |
| 485268 | 5/1975 | Australia | 248/48.2 |
| 666659 | 2/1952 | United Kingdom . | |
| 672950 | 5/1952 | United Kingdom . | |
| 759039 | 10/1956 | United Kingdom . | |

*Primary Examiner*—J. Franklin Foss

*Attorney, Agent, or Firm*—Schwartz, Jeffery, Schwaab, Mack, Blumenthal & Evans

[57] ABSTRACT

A fascia-gutter system has a series of fascia brackets fixed to the rafters of a building structure to support a roll-formed metal fascia snapped onto the brackets. The top portion of the fascia supports the roofing tiles and the bottom portion supports the soffit. A tunnel formation having opposed channels releasably supports the backing plates of a series of mounting brackets locked into the fascia. Releasably engageable formations are provided on the backing plate and on flanges of the mounting bracket. Similar formations are also provided on mounting plate. The mounting brackets supports respective gutter brackets at selective relative heights to provide the desired fall to a gutter supported by brackets allow the fall to be accurately set.

7 Claims, 2 Drawing Figures

FASCIA-GUTTER BRACKET ASSEMBLY

BACKGROUND OF THE INVENTION (1) Field of the Invention

This invention relates to improvements in a fascia-gutter system for building construction.

(2) Prior Art

Building cost increases have forced builders to seek alternative construction methods to reduce costs both in the areas of materials and labour. One area of attention has been in the adoption of pre-fabricated fascia-gutter systems where the components are clipped or otherwise fixed together. An example of such a system is disclosed in Australian Pat. No. 464694, dated Sept. 20, 1973 and granted to Stratco Metal Proprietary Limited.

While many of these systems have reduced the labour costs over conventional fascia-gutter systems, they generally rely on a large number of components e.g. clips and brackets to enable the systems to be effective in all applications and the requirement for all these components make the systems expensive to produce.

SUMMARY OF THE PRESENT INVENTION

It is an object of the present invention to provide a fascia-gutter system which uses a minimum number of preferred components.

It is a preferred object to provide a system which requires few tools for installation and where the components can be snapped or slid together.

It is a further preferred object to provide a system which can be assembled in its entirety for a new fascia-gutter system or where the components of the system may be used with existing structures to form a fascia-gutter system.

In one aspect the present invention resides in a gutter bracket assembly for a fascia-gutter system including:

a mounting bracket having a backing plate connectable to a fascia and a pair of opposed flanges spaced from the backing plate; and a gutter bracket having a mounting plate engageable with the backing plate and flanges of the mounting bracket and a support arm extending forwardly from the mounting plate and engageable with a portion of a front wall of a gutter to support the gutter, wherein:

releasably engageable formations are provided on the backing plate and/or flanges of the mounting bracket and on the mounting plate of the gutter bracket to enable the gutter to be supported in a range of height adjustments relative to the fascia.

Preferably the formations include, dimples, ribs, slots, teeth or tabs so arranged that the formation on the mounting plate of the gutter bracket is adapted to engage corresponding or co-operating formations on the backing plate of the mounting bracket. Preferably visual markings are provided on one of the components to enable the fall of the gutter to be accurately set.

Preferably the gutter bracket assembly is used with a fascia having a fascia panel terminated by rearwardly directed top and bottom portions adapted to enable the fascia to be secured to a building structure, a "tunnel-like" formation being provided in the fascia panel having a face panel spaced rearwardly of the fascia panel and interconnected thereto by upper and lower opposed channel-like formations. The top and bottom portions of the fascia may be adapted to "snap-onto" one or more fascia brackets fixed to rafters of the structure.

The top portion may be of double thickness for increased strength to enable the fascia to act as a tilting batten for roof tiles, while the bottom portion, which may also be of double thickness may include a rearwardly directed mouth to receive a soffit. When the fascia is to be placed over an existing timber fascia, the top portion may be omitted.

The tunnel-like formation may slidably receive the backing plate of the mounting bracket. However, it is preferred that the backing plate be locked into the formation by rotation from a horizontal insertion position to a vertical locked position. Preferably the mounting plate has a vertical dimension substantially equal to, and a horizontal dimension less than, the distance between the upper and lower channels, with a pair of opposed large radius corners which provide clearance to enable the mounting bracket to be rotated to the locked position. The gutter may have a front wall and a rear wall interconnected by a floor, with the front wall higher than the rear wall. A heel portion may be provided at the junction of the floor and the rear wall to be releasably engaged by a flange on the mounting plate of the gutter bracket and roll portion may be provided on the front wall to be engaged by a nose on a support arm on the gutter bracket. Longitudinal slots may be provided in the front wall, below the level of the top of the rear wall, to prevent water overflowing over the rear wall into the building structure.

In a second aspect the present invention may reside in a fascia hereinbefore described.

In a third aspect, the present invention may reside in a fascia-gutter system incorporating the components hereinbefore described.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENT

Figure 1:
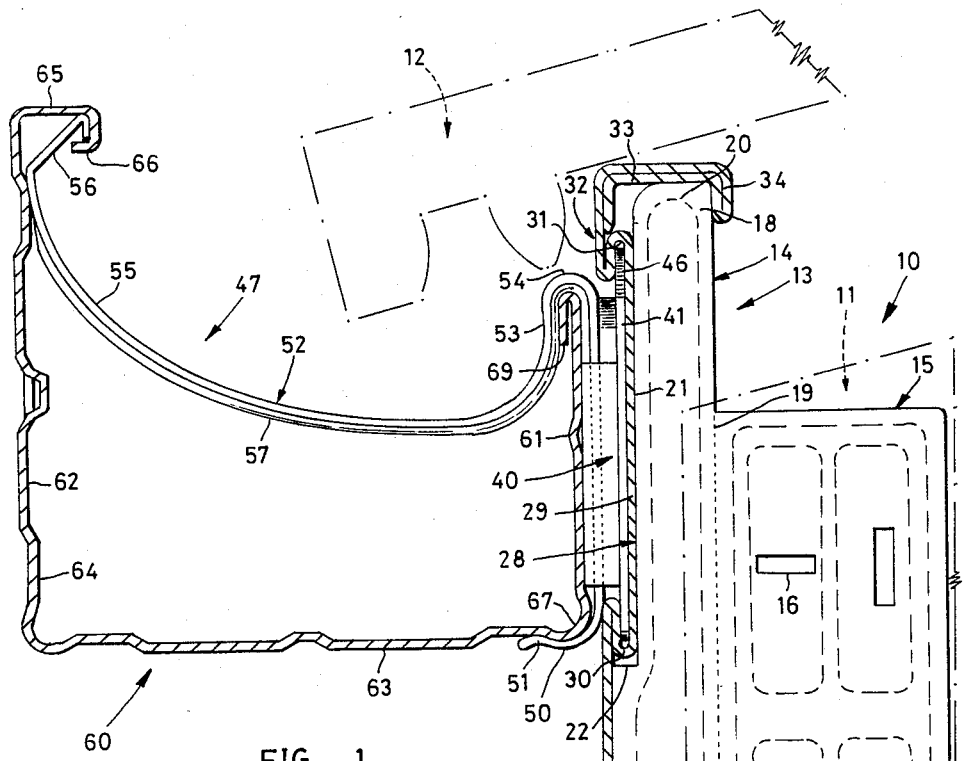
FIG. 1 is a sectional end view of the fascia-gutter assembly fitted to a building structure.
Figure 2:
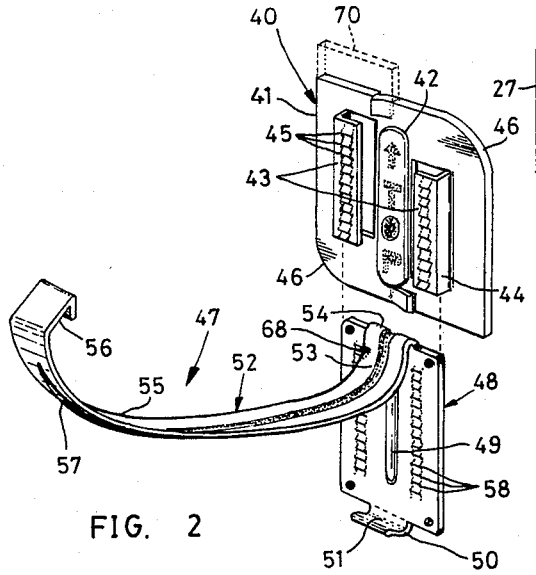
FIG. 2 is a perspective view of the gutter bracket and mounting bracket, separated for clarity.

The building structure 10 has a series of parallel rafters 11 supporting roof tiles 12 via battens (not shown).

A fascia bracket 13 is fixed to the free end of each rafter 11 and is pressed from sheet metal. The bracket has a body portion 14 provided with a rearwardly directed flange 15 provided with holes or slots 16 to enable it to be fixed to the rafters 11 by nails or screws. Stiffening ribs 17 are pressed out of the flange 15 to one side of the flange to stiffen the flange, while enabling the flange to be fixed to either side of the rafters. (A similar peripheral stiffening rib 18 is provided to strengthen the body portion 14).

A crease line 19 is provided at the junction of the body portion 14 and flange 15 to enable the former to be bent when the fascia bracket is used to support the fascia at a hip in the roof or when the fascia is used as a barge board for a gable.

The top portion 20 of the body portion is curved and leads into the upper front face 21, which is terminated by a ledge 22. A lower front face 23 leads into a curved lower portion 24 provided with a rearwardly directed socket 25.

The fascia 26 is continuously roll formed from sheet metal coil (which may be provided with a coloured finish) and is cut to the desired length. The fascia has a fascia panel 27 which bears against the lower front face 23 of the gutter bracket. A tunnel formation 28 is provided above the fascia panel and has a face panel 29 spaced rearwardly of the fascia panel and is connected thereto by an S-section piece (formed by rollforming) forming a lower channel 30. A similar S-section forms an upper channel 31 which leads to a top portion 32 which is of double thickness inverted U-shape with a horizontal web 33 and vertical flange 34 which "snaps" over the top of the body portion 14 of the fascia bracket 13. The roof tiles 12 bear on the top portion 32 of the fascia 26 which acts as a tilting batten.

The bottom portion 35 of the fascia has a horizontal web 36 which leads to a double-thickness S-shaped section 37 which has a rearwardly directed mouth 38 to receive a soffit 39.

The fascia 26 is fitted to the building structure in the following manner. Tow or more fascia brackets 13 are aligned and fixed to respective rafters 11 e.g. by nailing. (Normally each rafter is provided with a respective bracket). The fascia 26 is brought up to the brackets and the S-section 37 of the bottom portion 35 is engaged in the sockets 25 of the bottom portions of the brackets. The fascia is swung upwardly and the lower channel 31 engages the ledge 22 of the brackets. The vertical flange 34 then rides up and over the curved top portion 20 of the brackets and snaps into engagement with the brackets to secure the fascia. (In a modified embodiment not shown, a rearwardly directed rolled portion in the fascia panel 27 may be engaged in a locking socket formed in the lower front face 23 of the brackets).

The double thickness top and bottom portions 32, 35 and the tunnel formation 28 increase the strength of the fascia, allowing the use of thinner gauge sheet steel. The mounting bracket 40 has a backing plate 41 reinforced by a central rib 42 (and holes may be provided in the backing plate to enable the bracket to be fixed directly to a wooden fascia with nails or screws).

A pair of offset vertical support flanges 43 are pressed out of the backing plate 41 and are connected thereto by webs 44, the distance between the flanges and the backing plate being approximately equal to, or greater than, twice the thickness of the plate. A plurality of teeth 45 are pressed into the flanges 43 at regularly spaced intervals. The backing plate 41 has a vertical dimension, approximately equal to the distance between the upper and lower channels 31, 30 selected to enable the bracket 40 to be locked in the tunnel formation 28 of the fascia 26. The horizontal dimension of the backing plate is less than the distance between the channels and is selected to enable the backing plate 41 to be inserted into the tunnel formation when the bracket is turned horizontally, the opposed large radius corners 46 enabling the bracket to be then rotated to its upright position to be locked into the tunnel formation 28. (The offset vertical flanges 43 and webs 44 provide clearance as the mounting bracket is rotated to its locked position in the fascia but ensure that the mounting bracket can only be locked the correct way up).

The gutter bracket 47 has a mounting plate 48 adapted to be slidably engaged between the flanges 43 and backing plate 41 of the mounting bracket 40, the mounting plate having a rearwardly directed central stiffening web 49. A forwardly directed bottom flange 50 (of reduced width) has a transverse crease 51 spaced from the mounting plate 48. The gutter support arm 52 (also of reduced width) has a rear portion 53 substantially parallel to, but spaced forwardly from, the mounting plate 48 and is connected thereto by a curved portion 54. The rear portion 53 leads into a curved, upwardly inclined front portion 55 terminated by a rolled rearwardly directed nose 56. A stiffening rib 57 is provided along the underside of the front and rear portions 53, 55 of the support arm and around the curved portion 54 to increase their strength.

A series of transverse slots or ribs 58 are pressed or formed in the mounting plate 48 to be engaged by the teeth on the mounting bracket 40 to enable the gutter bracket 47 to be set at various height adjustments relative to the mounting bracket and the fascia 26 to enable the desired fall to be applied to a gutter. The degree of fall can be calculated and then the gutter brackets 47 at the end of the fascia 26 can be set at the desired relative heights by adjusting them using graduated markings 59 on the mounting plate 48 relative to the underside of one of the flanges 42 on the mounting bracket 40.

As hereinbefore described, the mounting brackets 40 are locked into the fascia 26 at the desired positions with the upper and lower edges of the backing plates 41 engaged in the upper and lower channels 31, 30 in the fascia 26.

The mounting plates 48 of the gutter brackets 47 are then engaged in the mounting brackets and adjusted to the desired height, the teeth 45 and slots or ribs 58 locking the gutter brackets 47 against downward movement. The gutter 60 has a rear wall 61, a front wall 62 of greater height than the rear wall, a floor 63, and is continuously roll-formed of sheet-metal coil and may be provided with a coated or galvanized finish. Longitudinal conformations 64 are provided along the front wall 62 and floor 63 to increase the strength and aesthetic appeal.

A roll portion 65 is provided along the top of the front wall 62 and has an inwardly directed flange 66 adapted to engage the nose portion 56 of the gutter bracket 47. A heel 67 is formed at the junction of the rear wall 61 and floor 63 and is releasably engaged by the creases 51 on the bottom flanges 50 of the gutter brackets. Longitudinal slots (not shown) may be formed at spaced intervals in one of the conformations 64 in the front wall to enable water to run through the slots and down the front wall of the gutter to prevent the water level reaching the top of the back wall 61.

An inturned tab 68 on the rear portion 53 of the support arm 52 engages under the rolled-over top edge 69 of the rear wall 61 of the gutter to secure the rear wall in position.

To fit the gutter 60 to the previously installed gutter brackets 47, the top edge 69 of the rear wall 61 of the gutter is pushed up between the rear portion 53 of the gutter support arm 52 and the mounting plate 48 until it engages the curved portions 54 and the tab 68. The gutter 60 is swung down and the heel 67 is engaged by the crease 51 to lock it in position. The rolled nose 56 is then snapped into position in the roll portion 65 and engaged with the rearwardly directed flange 66.

It will be readily apparent to the skilled addressee that the fascia gutter system described above can be easily assembled and relies on the use of only five components i.e. the fascia bracket 13, the fascia 26, the mounting plate 40, gutter bracket 47 and gutter 60. Both the fascia 26 and gutter 60 can be given a wide range of profiles to produce an attractive range of systems. The flexible design of the fascia bracket eliminates the need for additional right and left hand hip fascia brackets or a barge board bracket as required in known systems.

In renovation of older houses fitted with timber fascias, a metal restoration fascia may be used which is generally similar to the fascia 26 but does not incorporate the web 33 or flange 34 of the top portion 32, which is simply planar. The restoration fascia is fixed to the front of the timber fascia by nailing or screwing and enable the mounting plate 40/gutter bracket 47/gutter 60 of the present system to be used.

Where the timber fascia is in good condition or is to be used as feature of the building, the mounting plates 40 can be nailed or screwed directly to the fascia, being aligned with the fascia by a bendable tab 70 provided on the backing plate 41 which is bent over the top of the fascia.

In a further modified embodiment, the top end of the rear wall 61 of the gutter and the heel 67, may be engaged in enlarged upper and lower channels 31, 30 of tunnel formation 28 of the fascia.

Various other changes and modifications may be made to the embodiments described without departing from the scope of the present invention as hereinafter defined in the appended claims.

I claim:

1. A fascia-gutter system including:

a mounting bracket having a backing plate connectable to a fascia and a pair of opposed flanges spaced from the backing plate;

a gutter bracket having a mounting plate engageable with the backing plate and flanges of the mounting bracket and a support arm extending forwardly from the mounting plate and engageable with a portion of a front wall of a gutter to support the gutter;

releasably engageable formations provided on said flanges of the mounting bracket and on the mounting plate of the gutter bracket to enable the gutter to be supported in a range of height adjustments relative to the fascia, and a fascia having a fascia panel with a tunnel-like formation having a face panel spaced rearwardly of the fascia panel and interconnected to the fascia panel by upper and lower opposed channel-like formations, and so arranged that the backing plate of the mounting bracket is slidably or releasably engageable in the tunnel-like formation.

2. A system as claimed in claim 1 wherein:

the backing plate has a vertical dimension substantially equal to and a horizontal dimension less than the distance between the upper and lower channel-like formations.

3. A system as claimed in claim 1 wherein:

the backing plate has a pair of opposed large radius corners to enable the backing plate to be inclined for insertion into the tunnel-like formation and then rotated to a locked position in engagement with the upper and lower channel-like formations.

4. A system as claimed in claim 1 wherein:

the fascia has a top and bottom portion adapted to be snapped onto fascia brackets fixed to one or more rafters of a building structure, the top portion being adapted to support roofing tiles as a tilting batten and the bottom portion having a rearwardly directed mouth to receive a soffit.

5. A system as claimed in claim 4 wherein:

the fascia brackets having a body portion engaged by the fascia and a rearwardly directed flange to be fixed to the rafters by fasteners, a crease line being provided at the junction of the body portion and flange to enable the fascia brackets to be bent to support the fascia at a hip or as a barge board for a gable roof.

6. A system as claimed in claim 1, further including a gutter having a front wall and a rear wall interconnected by a floor, the front wall being higher than the rear wall, and wherein a heel is provided at the junction of the rear wall and the floor to be releasably engaged by a flange on the bottom edge of the mounting plate of the gutter bracket, and a roll portion along the top of the front wall engageable by a nose on the forward end of the support arm of the gutter bracket.

7. A system as claimed in claim 6 wherein:

the support arm has a rear portion spaced forwardly of the mounting plate, the top edge of the rear wall of the gutter being releasably engageable between the rear portion and the mounting plate, an inturned tab on the rear portion securing the rear wall in position.

* * * * *